United States Patent [19]

Ampferer

[11] Patent Number: 4,709,670

[45] Date of Patent: Dec. 1, 1987

[54] FASTENING ARRANGEMENT OF A COVER HOOD AT A CYLINDER HEAD

[75] Inventor: Herbert Ampferer, Bietigheim-Bissingen, Fed. Rep. of Germany

[73] Assignee: Dr. Ing.h.c.F. Porsche Aktiengesellschaft, Stuttgart, Fed. Rep. of Germany

[21] Appl. No.: 868,322

[22] Filed: May 29, 1986

[30] Foreign Application Priority Data

May 29, 1985 [DE] Fed. Rep. of Germany ..... 3519205

[51] Int. Cl.[4] ..... F02F 7/00

[52] U.S. Cl. ..... 123/195 C; 123/198 E

[58] Field of Search ..... 123/195 C, 198 E, 90.38

[56] References Cited

U.S. PATENT DOCUMENTS

| | | | |
|---|---|---|---|
| 3,924,597 | 12/1975 | Hatz et al. | 123/198 E |
| 4,151,823 | 5/1979 | Grosse et al. | 123/196 A |

FOREIGN PATENT DOCUMENTS

| | | | |
|---|---|---|---|
| 0070500 | 1/1983 | European Pat. Off. | 123/195 C |
| 363657 | 12/1921 | Fed. Rep. of Germany | 123/195 C |
| 3009302 | 9/1980 | Fed. Rep. of Germany . | |
| 3429635 | 2/1986 | Fed. Rep. of Germany | 123/198 E |
| 0077548 | 6/1981 | Japan | 123/198 E |
| 0045769 | 3/1985 | Japan | 123/198 E |

*Primary Examiner*—Craig R. Feinberg
*Assistant Examiner*—David A. Okonsky

[57] ABSTRACT

A cover hood is secured at the cylinder head by means of detachable retaining elements whereby a sealing member is provided between sections of the cylinder head and of the cover hood which are placed at one another. The retaining elements are formed by spring clamps which with mutually facing nose-shaped support areas engage in adjacent mounting recesses provided in vertical boundary walls of the cover hood and of the cylinder head in such a manner that the direction of action of the support areas of the spring clamps lies approximately on a vertical line that includes a center line of the sections and of the sealing member.

18 Claims, 4 Drawing Figures

FASTENING ARRANGEMENT OF A COVER HOOD AT A CYLINDER HEAD

The present invention relates to a fastening arrangement of a cover hood at a cylinder head of an internal combustion engine by means of detachable retaining elements, whereby a sealing member is provided between sections of the cylinder head and cover hood which are attached to one another.

In a known internal combustion engine (DE-OS No. 30 09 302), the cover hood is secured at the cylinder head by means of bolts. For that purpose, fastening eyes are provided at the hood and threaded bores in the cylinder head. This construction entails the disadvantage that not only the fastening eyes and the threaded bores involve relatively high manufacturing expenditures, but also that the relatively long—and also costly—bolts increase the weight of the internal combustion engine.

It is the principal object of the present invention to provide a fastening arrangement of a cover hood at a cylinder head of an internal combustion engine whose retaining elements have a slight weight as well as can be easily manufactured and installed and with which the measures for the mounting of this retaining element at the cylinder head and at the valve cover hood are simple from a manufacturing point of view.

The underlying problems are solved according to the present invention in that the retaining elements are constituted by spring clamps which engage with mutually facing nose-shaped support areas in adjacent mounting recesses provided in vertical boundary walls of the cover hood and of the cylinder head in such a manner that the direction of action of the support areas of the spring clamps lie approximately on a vertical line which includes a center line of the sections and of the sealing member.

The principal advantages attainable with the present invention reside in that the spring clamps together with their support areas are components which can be manufactured in an easy and simple manner. Additionally, the installation expenditure is reduced thereby. Added thereto is the fact that the mounting recessed at the cylinder head and at the cover hood can be realized without any problems from a manufacturing point of view.

This type of fastening is particularly suitable if the cover hood is of lightweight, for example, consists of plastic material, magnesium and thin steel sheet metal parts. On the one hand, a positional determination of the spring clamps is realized by the ribs at the cylinder head, respectively, at the valve hood and, on the other, the spring clamps are covered off thereby. Finally, the possibility exists by the extension of the support areas to release the spring clamps by means of a suitable tool (screwdriver).

These and other objects, features and advantages of the present invention will become more apparent from the following description when taken in connection with the accompanying drawing which shows, for purposes of illustration only, one embodiment in accordance with the present invention, and wherein.

Figure 1:
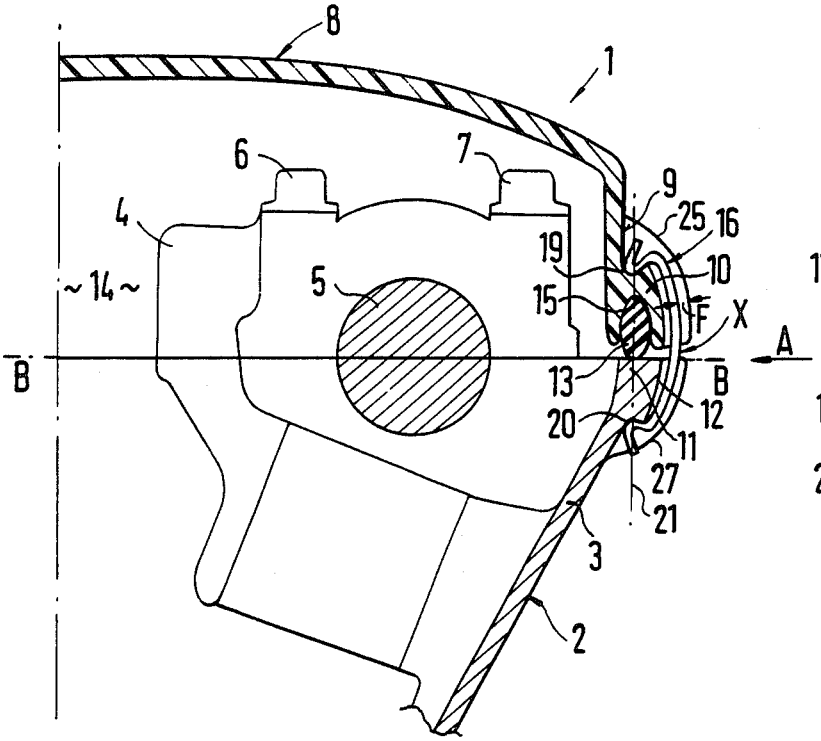
FIG. 1 is a partial cross-sectional view through an internal combustion engine within the area of a cylinder head in accordance with the present invention.

Referring now to the drawing wherein like reference numerals are used throughout the various views to designate like parts, and more particularly to FIG. 1, the internal combustion engine generally designated by reference numeral 1 includes within the illustrated area a cylinder head generally designated by reference numeral 2 which is formed by a bottom part 3 and by a top part 4. A cam shaft 5 is arranged between the bottom part 3 and the top part 4 which are assembled in a horizontal plane B—B. Bolts 6 and 7 serve for retaining the top part 4 at the bottom part 3.

A cover hood 8 of plastic material, light metal, thin-walled steel sheet metal or the like is provided above the top part 4 which has a trough-like base shape. Vertical boundary walls 9 of the cover hood 8 are connected with the sections 10 thereof at sections 11 of also vertical boundary walls 12 of the cylinder head 2. A sealing body 13 having an elliptical or circular cross section and consisting of an elastic material is provided between the sections 10 and 11 and assures that the space 14 formed by the cover hood 8 and the cylinder head 2 is closed off oil-tight. A recess 15 is provided at least in the section 10 for mounting the sealing member 13.

Several detachable retaining elements which are formed by spring clamps generally designated by reference numeral 16, serve for fastening the cover hood 8 at the cylinder head 2. The spring clamps 16 have an arcuate shape and are provided at their ends with mutually facing support areas 17 and 18. The support areas 17 and 18 which are formed by bent-off portions, engage in corresponding recesses 19 and 20 of the cover hood 8 and of the cylinder head 2. The mounting recesses 19 and 20 are provided along the outside of the cover hood 8 and of the cylinder head and more particularly adjacent the boundary walls 9 and 12.

The direction of action C—C (FIG. 4) of the support areas 17 and 18 of the spring clamps 16 lies on a vertical line 21 (FIG. 1) which includes a center line of the sections 10 and 11 and of the sealing member 13.

Figure 4:
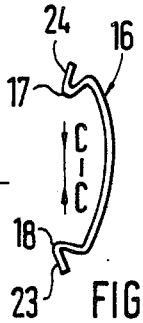
FIG. 4 is an elevational view of the detail X of FIG. 1.
Figure 3:
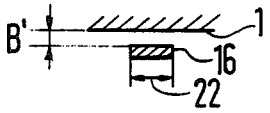
FIG. 3 is a partial cross-sectional view, taken along line III—III of FIG. 2.

The spring clamps 16 which have a rectangular cross section whose longer side 22 extends parallel to the internal combustion engine—distance B' (FIG. 3)—, are provided on the free sides of their support areas 17 and 18 with extensions 23 and 24 (FIG. 4). These extensions 23 and 24 are bent away from the cylinder head 2 and from the cover hood 8 in such a manner that they can be engaged from behind with a tool, for example, a screwdriver for the disengagement of the spring clamps 16.

Figure 2:
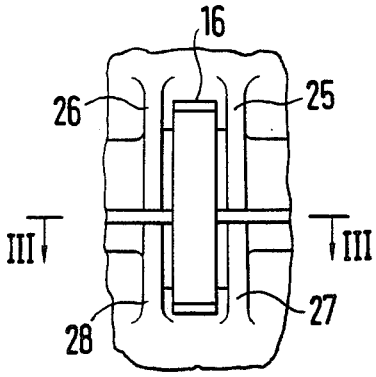
FIG. 2 is a partial elevational view, taken in the direction of arrow A of FIG. 1.

For the purpose of a simple—also uniform—positional determination of the spring clamps 16, the latter are delimited by ribs 25, 26 and 27, 28 which are formed-on at the cover hood 8, respectively, at the cylinder head 2 (FIG. 2). The contour of these ribs is so constructed that the contour of the spring clamps 16 lies inside of the contour of the ribs 25, 26 and 27, 28 (FIG. 1-distance F).

The properties of setting behavior, volume and material of the sealing member 13 and the spring force of the spring clamps 16 can be matched empirically to one another.

While I have shown and described only one embodiment in accordance with the present invention, it is understood that the same is not limited thereto, but is susceptible of numerous changes and modifications as known to those skilled in the art, and I therefore do not wish to be limited to the details shown and described herein but intend to cover all such changes and modifications as are encompassed by the scope of the appended claims.

I claim:

1. A fastening arrangement of a cover hood at a cylinder head of an internal combustion engine, comprising detachable retaining means, and seal means provided between sections of the cylinder head and of the cover hood which are placed adjacent one another, the retaining means being formed by spring clamps exhibiting mutually facing nose-shaped supports areas which apply resilient clamping forces in a clamping direction corresponding to a line through said nose-shaped support areas, said spring clamps being disposed such that the nose-shaped support areas engage in adjacent mounting recesses provided in substantially vertical boundary walls of the cover hood and of the cylinder head in such a manner that the clamping direction of action of the support areas of the spring clamps lies approximately on a vertical line that includes substantially a center line of the sections and of the sealing means.

2. A fastening arrangement according to claim 1, wherein the cover hood consists of plastic and is retained at the cylinder head far-reachingly free of bending moments by means of the spring clamps.

3. A fastening arrangement according to claim 1, wherein the support areas of the spring clamps are provided on their free sides with extensions which are bent away from the cylinder head and from the cover hood.

4. A fastening arrangement according to claim 1, wherein the spring clamps have an arcuate shape.

5. A fastening arrangement according to claim 1, wherein the cover hood consists of light metal and is retained at the cylinder head far-reachingly free of bending movements by means of the spring clamps.

6. A fastening arrangement according to claim 1, wherein the cover hood consists of thin-walled steel sheet metal or the like and is retained at the cylinder head far-reachingly free of bending movements by means of the spring clamps.

7. A fastening arrangement according to claim 1, wherein the spring clamps are delimited by ribs provided at the cover hood and at the cylinder head.

8. A fastening arrangement according to claim 7, wherein the ribs project beyond the contour of the spring clamps.

9. A fastening arrangement according to claim 1, wherein the spring clamps cooperate with the cover hood and the cylinder head exclusively by way of the support areas.

10. A fastening arrangement according to claim 9, wherein the support areas of the spring clamps are provided on their free sides with extensions which are bent away from the cylinder head and from the cover hood.

11. A fastening arrangement according to claim 9, wherein the spring clamps have an arcuate shape.

12. A fastening arrangement according to claim 1, wherein said spring clamps have a rectangular cross section.

13. A fastening arrangement according to claim 12, wherein the spring clamps are delimited by ribs provided at the cover hood and at the cylinder head.

14. A fastening arrangement according to claim 13, wherein the ribs project beyond the contour of the spring clamps.

15. A fastening arrangement according to claim 14, wherein the support areas of the spring clamps are provided on their free sides with extensions which are bent away from the cylinder head and from the cover hood.

16. A fastening arrangement according to claim 15, wherein the spring clamps have an arcuate shape.

17. A fastening arrangement according to claim 16, wherein the spring clamps cooperate with the cover hood and the cylinder head exclusively by way of the support areas.

18. A fastening arrangement according to claim 16, wherein the cover hood consists of plastic and is retained at the cylinder head far-reachingly free of bending moments by means of the spring clamps.

* * * * *